US005600084A

United States Patent [19]

Gonzalez

[11] Patent Number: 5,600,084

[45] Date of Patent: Feb. 4, 1997

[54] ARMOR PANEL FASTENER DEVICE

[75] Inventor: René G. Gonzalez, Southfied, Mich.

[73] Assignee: The United States of America as represented by the Secretary of the Army, Washington, D.C.

[21] Appl. No.: 605,289

[22] Filed: Jan. 16, 1996

[51] Int. Cl.[6] ..... F41H 5/013; F41H 5/04

[52] U.S. Cl. ..... 89/36.02; 89/36.07; 89/36.08

[58] Field of Search ..... 89/36.01, 36.02, 89/36.04, 36.05, 36.06, 36.07, 36.08; 109/49.5, 78, 79, 81

[56] References Cited

U.S. PATENT DOCUMENTS 620,073 2/1899 Holmes ..... 109/83
1,425,324 8/1922 Kennedy ..... 109/79
4,021,974 5/1977 Edwards ..... 52/63

FOREIGN PATENT DOCUMENTS 282112 2/1931 Italy ..... 89/36.01
2007256 5/1979 United Kingdom ..... 89/36.02

*Primary Examiner*—Stephen M. Johnson
*Attorney, Agent, or Firm*—Peter A. Taucher; Gail S. Soderling

[57] ABSTRACT

A web structure adapted to retain portions of an armor structure is disclosed. The structure will prevent or limit the incidence of secondary projectile injuries caused by fastener degradation caused by threat incursion.

2 Claims, 1 Drawing Sheet

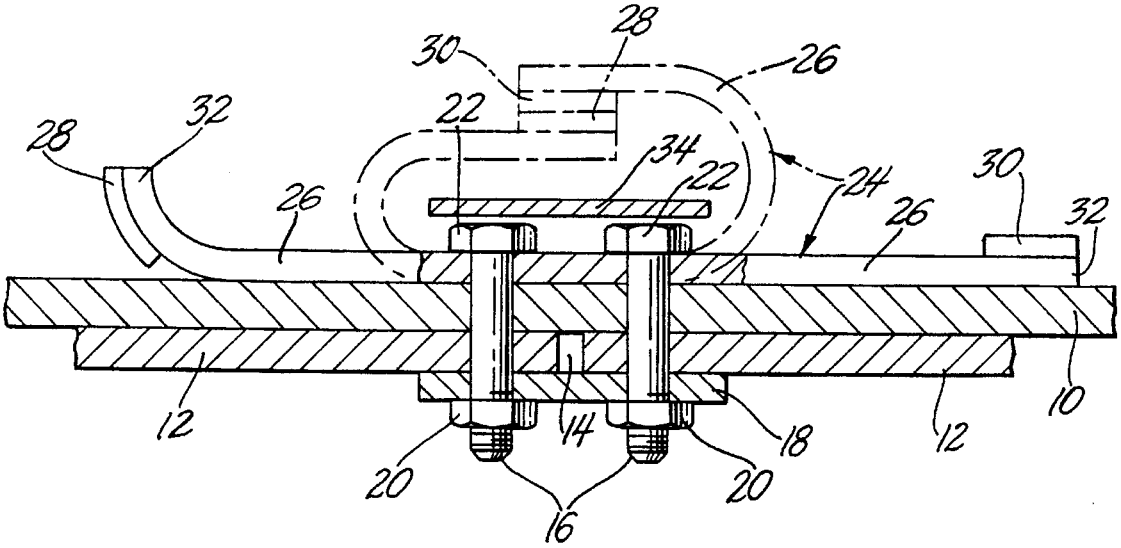
28
30
26
32
22
28
34
22
24
30
26
26
32
12
14
18
12
10
20
20
16

ARMOR PANEL FASTENER DEVICE

GOVERNMENT INTEREST

The invention described herein may be manufactured, used and licensed by or for the Government for governmental purposes without payment to me of any royalty.

BACKGROUND OF THE INVENTION

1. Field of the Invention

In one aspect this invention relates to a method of fastening armor to a vehicle. In yet a further aspect this invention relates to auxiliary armor fastening devices.

2. Prior Art

It is often desirable to add additional armor material to existing military vehicles after the vehicle has been built. Sometimes these vehicles are armored in discrete segments so as to allow individual segments of the armor to be replaced for upgrade and or repair in the field. It has been proposed to fasten the armor segments to the vehicle by using threaded fasteners attached to the vehicle with the threaded ends extending away from the vehicle which would allow armor segments to be placed on the studs and the panels attached with nuts or similar fasteners.

The prior art plate structures allowed the upgrading and repair of armored vehicles in the field using threaded fasteners or rivets but have certain associated problems. In particular, when armor is struck, the nuts, rivet heads or other fastening means on the vehicle interior tend to break loose from the fastener body and become secondary projectiles endangering the vehicle occupants.

The hazards posed by the secondary projectiles was considered unacceptable and welding of armor has become the defacto standard of armoring vehicles. However, welding has its own set of disadvantages. Certain types of vehicles such as light weight general purpose trucks do not have a suitable structure with attachment points for welded armor panels limiting the vehicles to which armor can be applied to large vehicles. Further, because armor welding requires specialized techniques, welding equipment suitable for use on armor materials is not available for repairing vehicles in the field. Further certain types of advanced armors are not weldable and a mechanical fastening means is required.

It would be desirable to have a mechanical means of mounting armor segments on a vehicle which provides a means to limit the possibility of the mechanical fastening means becoming a secondary projectile.

BRIEF SUMMARY OF THE INVENTION

The problem of the prior art are ameliorated by the present invention. The present invention is an armoring structure using a plurality of fasteners to attach armor panels to the exterior of a vehicle, the mechanical fasteners being associated with the vehicle body. The armor panels are attached to the vehicle by passing the mechanical fasteners through complimentary apertures in the armor panels to provide an armor shell for the vehicle. The armor structure of the present invention has a secondary projectile containment means associated with the fasteners, the containment means being associated with a least a portion of the fasteners to contain any portion of the fastener which separates from the body of the fastener the containment means being associated with that portion of the fastener located closest to the interior of the vehicle. The containment means includes a web of strong ballistic grade fabric material having apertures which correspond to the mechanical fasteners used to hold the armor in place. A portion of the web is disposed between the armor panels and that portion of the fasteners to be contained with the remainder of the web extending outward. The web is flexible enough to be curled back on itself so that the web will surround the enlarged portion of the fasteners. The web has closure means at its edges to close and retain the web's edges closed to form an envelope around the fasteners. If desired a secondary sheet of solid ballistic material can be placed atop the fasteners and enclosed within the web envelope to provide a means to absorb and dissipate any incursion of the fasteners should they become separated from the fastener body.

BRIEF DESCRIPTION OF THE DRAWING

In the accompanying drawing:

FIG. 1 is a side view of one embodiment of this invention.

DETAILED DESCRIPTION OF PREFERRED EMBODIMENTS

Referring to the drawing, a portion of a vehicle body 10 is shown with an armor structure according to this invention attached to provide increased safety to the vehicle's personnel. On the threat side or outer surface of the vehicle 10, two armor plates 12 have been placed in contact with the vehicle to provide protection to the vehicle personnel inside the vehicle. The armor plates 12 will abut each other at a seam 14 which is shown as a gap. In actual practice, the spacing between the plates 12 will be minimized to minimize any unprotected area. The plates 12 are shown held in place by a plurality of bolts 16 associated with each plate only one bolt per plate being shown in the drawing.

The bolts 16 pass through complimentary apertures in the vehicle body 10 panels and complimentary apertures in the armor plates 12 to hold the armor plates in position on the vehicle. A shield panel 18 is disposed across the seam 14 to provide structural integrity and provide a measure of protection for the seam 14. Shield panel 18 also has apertures which engage the threaded fasteners 16 to hold the shield panel in place over the seam 14. The shield panel 18 can be formed of the same armor material as the underlying armor panels 12 or can be formed of a different material such as a ceramic plate. The underlying armor panels 12 and shield plates need not be the same material but the materials should be compatible so as not to cause galvanic couples or other structural problems which degrade the overall structure.

The shield panel 18 and armor panel 12 are held in contact with the vehicle body 10 using threaded nuts 20 which can be tightened to the desired torque to hold the armor panels 12 firmly in place.

The inner portion of the threaded fasteners 16 shown have a head 22 which provides the means to hold the plates in contact with the inner side of the vehicle 10 body. The heads 22 have an associated secondary containment structure designated generally 24 which serves to prevent or mitigate the threat one or more of the heads 22 will become a secondary projectile if separated from the rest of the fastener. The secondary containment structure 24 shown open in full line and closed in broken line includes a web 26 of ballistic grade material having apertures which extend through the web and are adapted to surround the body of fasteners 16. A portion of the ballistic material web 26 is juxtaposed the vehicle body panel 10 and lies between the body panel and fastener's heads 22. The web 26 has associated cooperating closure means 28, 30 located on the peripheral edges 32. The closure means 28, 30 cooperate to close the web 26 into an envelope structure which surrounds the heads 22. The web of material 26 is held in close proximity to the heads 22 and will retain the fasteners heads should they be separated from the rest of the fastener. This prevents the heads 22 from becoming secondary projectiles and endangering the vehicle occupants.

The closure means 28, 30 could be a hook and loop fastener, such as, "Velcro", snaps, a zipper, or lacing. The closure technique will have sufficient strength to maintain envelope integrity when the heads 22 become disengaged from the fasteners body.

In the embodiment shown, a thin shield 34 overlies the heads 22 and is held in position juxtaposed the heads 22 by the web 26 when the envelope is formed. The shield 34 provides a means to spread the force of a dislodged head over a larger area to help maintain envelope integrity. The shield 34 also protects the web from the cutting and abrasive action of the edges of heads 22 on the web providing additional protection against web degradation.

Various modifications and alterations will become apparent to those skilled in the art with out departing from the scope and spirit of this invention and it is understood that this invention is not limited to the illustrative embodiments set forth above.

What is claimed is:

1. An armor structure attached to a vehicle for protecting at least a portion of the vehicle comprising: a plurality of threaded fasteners attached to the vehicle to be armored, with the threaded potion of the fasteners extending outward from the vehicle surface, a plurality of individual armor panels to be attached to the vehicle, the individual armor panels being disposed in abutting fashion to form a protective layer, each individual armor panel having a plurality of apertures adapted to engage at least two of the threaded fasteners to secure the individual armor panel to the vehicle, the individual armor panels, being disposed so the threaded portion of the fasteners project through the apertures formed in the panel; a shield panel of ballistic material overlying and covering a seam formed at the abutment of adjoining individual armor panels, the shield panel located on the outer side of the individual panels, the shield panel having apertures which individually to receive at least two of the threaded fasteners; a plurality of projectile containment devices located on the side of the individual panels closest to the interior of the vehicle, each individual containment device having a web of ballistic material containing a plurality of apertures each aperture surrounding one fastener, and the web surrounding two or more adjacent fasteners, the web being disposed between the vehicle body and the portion of the fasteners inside the vehicle body, the web having portions extending outward from the fasteners, the web terminating in free ends, the free ends having closure means which cooperate to hold the free ends together to envelope the portion of the fasteners inside the vehicle.

2. An armoring structure for fastening a plurality of armor panels to the exterior of a vehicle using a multiplicity of mechanical fasteners associated with the vehicle body and the armor panels, by passing the mechanical fasteners through apertures in the armor panels a plurality of shield panels having apertures to engage the fasteners used in mounting the armor panels; the improvement comprising: a secondary projectile containment device associated with that portion of the fastener located closest to the interior of the vehicle, the containment device including a web of ballistic grade material having apertures which surround the fasteners, the ballistic material being juxtaposed that portion of the fasteners located on the interior of the armor panels, the web of material being sized so as to surround the portion of the fasteners closest to the interior of the vehicle, the web having closure means at its edges to close the web of fabric to form a closed envelope and a secondary sheet of ballistic material overlying the portion of the fasteners closest to the vehicle interior so that when the web of ballistic material is closed to form said envelope, the secondary sheet of ballistic material is held in close proximity to the fasteners to absorb and dissipate the force of the fasteners should they become separated from the remainder of the fastener due to the incursion of a threat.

* * * * *